US006959745B2

(12) United States Patent
Miyazaki et al.

(10) Patent No.: US 6,959,745 B2
(45) Date of Patent: Nov. 1, 2005

(54) STEEL CORD, METHOD OF MAKING THE SAME AND PNEUMATIC TIRE INCLUDING THE SAME

(75) Inventors: Shinichi Miyazaki, Kobe (JP); Kazumi Yamazaki, Kobe (JP); Osamu Toda, Kobe (JP)

(73) Assignee: Sumitomo Rubber Industries, Ltd., Hyogo-Ken (JP)

( * ) Notice: Subject to any disclaimer, the term of this patent is extended or adjusted under 35 U.S.C. 154(b) by 177 days.

(21) Appl. No.: 10/386,476

(22) Filed: Mar. 13, 2003

(65) Prior Publication Data

US 2003/0221762 A1 Dec. 4, 2003

(30) Foreign Application Priority Data

Mar. 13, 2002 (JP) ..... 2002-068891

(51) Int. Cl.[7] ..... B60C 9/20; B60C 9/00; D07B 1/06

(52) U.S. Cl. ..... 152/527; 57/200; 57/311; 57/902; 152/451

(58) Field of Search ..... 57/9, 311, 200, 57/902; 152/451, 527, 556

(56) References Cited

U.S. PATENT DOCUMENTS

| | | | | |
|---|---|---|---|---|
| 3,273,978 A | | 9/1966 | Paul et al. | |
| 5,319,915 A | | 6/1994 | Kobayashi et al. | |
| 5,487,262 A | * | 1/1996 | De Waegenaere et al. | 57/311 X |
| 6,308,508 B1 | * | 10/2001 | Han | 57/200 |
| 6,321,810 B1 | * | 11/2001 | Takahira | 152/527 |

FOREIGN PATENT DOCUMENTS

| | | | |
|---|---|---|---|
| EP | 0 841 430 A1 | | 5/1998 |
| FR | 2 060 690 A | | 6/1971 |
| GB | 208 207 A | | 12/1923 |
| JP | 05-279974 A | | 10/1993 |
| JP | 05279974 A | * | 10/1993 |
| JP | 08-074187 A | | 3/1996 |
| JP | 09-195187 A | | 7/1997 |
| JP | 09-209283 A | | 8/1997 |
| JP | 10-259582 A | | 9/1998 |
| JP | 11350366 A | * | 12/1999 |
| JP | 2000-273774 A | | 10/2000 |
| JP | 2002339278 A | * | 11/2002 |

* cited by examiner

*Primary Examiner*—Adrienne C. Johnstone
(74) *Attorney, Agent, or Firm*—Birch, Stewart, Kolasch & Birch, LLP

(57) ABSTRACT

A steel cord is composed of three to six steel filaments each having a filament diameter of from 0.25 to 0.45 mm, the three to six steel filaments including shaped filaments and twisted together, wherein the shaped filaments are, before twisted together, coiled to be set in a form of coil having a coil diameter of less than 5 mm and a coil pitch of more than 5 mm, the shaped filaments include at least two kinds of shaped filaments which are different in respect of the form of coil, the shaped filaments are twisted together while the coil diameter is reduced, the elongation of the cord at 50 N load is less than 0.2%, and the cord strength is in a range of from 2500 to 3500 N/sq.mm.

6 Claims, 2 Drawing Sheets

STEEL CORD, METHOD OF MAKING THE SAME AND PNEUMATIC TIRE INCLUDING THE SAME

The present invention relates to a steel cord for reinforcing rubber products, a method of making the steel cord and a pneumatic tire with a cord reinforced layer.

Pneumatic tires typical of rubber products are often reinforced with steel cords.

In recent years, a steel cord formed by twisting together steel filaments including a zigzag-waved filament is used to improve penetration of toping rubber into the cord on the other hand, as a conventional cord structure capable of improving the rubber penetration, there is a steel cord formed by loosely twisting linear filaments together.

In the latter, conventional structure, the twisted filaments are very likely to loose at cut ends of the cord. Thus, in making a cord reinforced rubber layer for a pneumatic tire, e.g. a belt ply, breaker ply, carcass ply and the like, the workability is very poor. Further, the initial elongation percentage of the cord is considerably large. This is of a problem because the dimensional stability is poor and accordingly it is difficult to maintain the dimensional accuracy in the finished tire.

The former, zigzag-waved structure is superior to the latter in respect of the initial elongation percentage. However, during waving or giving the zigzag-form permanent deformation to the filaments, the waved filament is liable to be damaged more or less depending on the way of waving, and the cord strength and fatigue resistance are decreased. Thus, the durability of the rubber product is deteriorated.

A primary object of the present invention is therefore, to provide a steel cord in which the rubber penetration into the cord is improved, the initial elongation percentage is held down, the workability is improved such that the twisted filaments are prevented from loose at cord cut ends, and the cord strength and durability are improved by preventing damage on the filaments.

Another object of the present invention is to provide a method of making such a steel cord.

Still another object of the present invention is to provide a pneumatic tire having a rubber layer reinforced with such a steel cord.

According to one aspect of the present invention, a steel cord is composed of three to six steel filaments each having a filament diameter of from 0.25 to 0.45 mm, wherein the three to six steel filaments include shaped filaments and are twisted together, the shaped filaments are, before twisted together, coiled to be set in a form of coil having a coil diameter of less than 5 mm and a coil pitch of more than 5 mm, the shaped filaments include at least two kinds of filaments which are different in respect of the form of coil, the shaped filaments are twisted together while the coil diameter is decreased, the elongation of the cord at 50 N load is less than 0.2%, and the cord strength is in the range of from 2500 to 3500 N/sq.mm.

According to another aspect of the present invention, a method of making the steel cord comprises twisting three to six steel filaments together into the cord, wherein each of the three to six steel filaments has a diameter of from 0.25 to 0.45 mm, and the three to six steel filaments include shaped filaments, thus the method further comprises making the shaped filament by coiling a steel filament, before twisted together, so that the coiled filament is set in a form of coil having a coil diameter of less than 5 mm and a coil pitch of more than 5 mm, and the above-mentioned twisting of the filaments is carried out while the coil diameter is decreased.

According to still another aspect of the present invention, a pneumatic tire is provided in a tread portion with a breaker made of the above-mentioned steel cords.

Embodiments of the present invention will now be described in detail in conjunction with the accompanying drawings.

Figure 2:
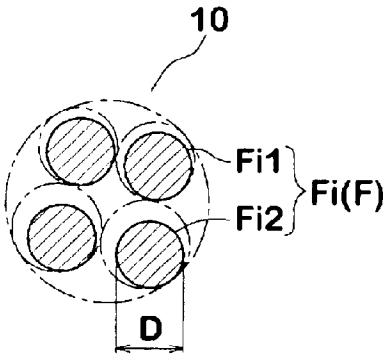
FIG. 2 is a cross sectional view of a steel cord according to the present invention.

In the drawings, pneumatic tire 1 according to the present invention comprises a tread portion 2, a pair of sidewall portions 3, a pair of bead portions 4 each with a bead core 5 therein, a carcass 6 extending between the bead portions 4, a belt 7, 9 disposed outside the carcass 6 in the tread portion 2.

In this embodiment, the tire 1 is a radial tire for passenger cars.

The carcass 6 is composed of at least one ply 6A of cords arranged radially at an angle of from 75 to 90 degrees with respect to the tire equator, extending between the bead portions 4 through the tread portion 2 and sidewall portions 3, and turned up around the bead core 5 in each of the bead portions 4 from the inside to the outside of the tire so as to form a pair of turned up portions 6*b* and a main portion 6*a* therebetween.

Organic fiber cords such as nylon, rayon and polyester are used as the carcass cords in this embodiment.

Between the turned up portions and main portion of the carcass 6 in each of the bead portions 4, there is disposed a bead apex 8 made of hard rubber extending radially outwardly from the bead core 5 and tapering towards the radially outer end thereof.

The belt includes a breaker 7 and optionally a band 9 covering at least the edges of the breaker 7.

In this embodiment, in order to improve the high-speed durability, a band 9 is disposed on the radially outside of the breaker 7. The band 9 is made up of at least one band cord wound spirally at an angle of not more than 5 degrees with respect to the tire equator. For the band cords, organic fiber cords, e.g. nylon and the like can be used. In this example, nylon is used.

The breaker 7 comprises two cross plies 7A and 7B of parallel cords laid at an angle of from 10 to 35 degrees with respect to the tire equator, extending across the substantially overall width of the tread portion 2.

A steel cord 10 according to the present invention is used in the breaker 7 in this embodiment.

Figure 3:
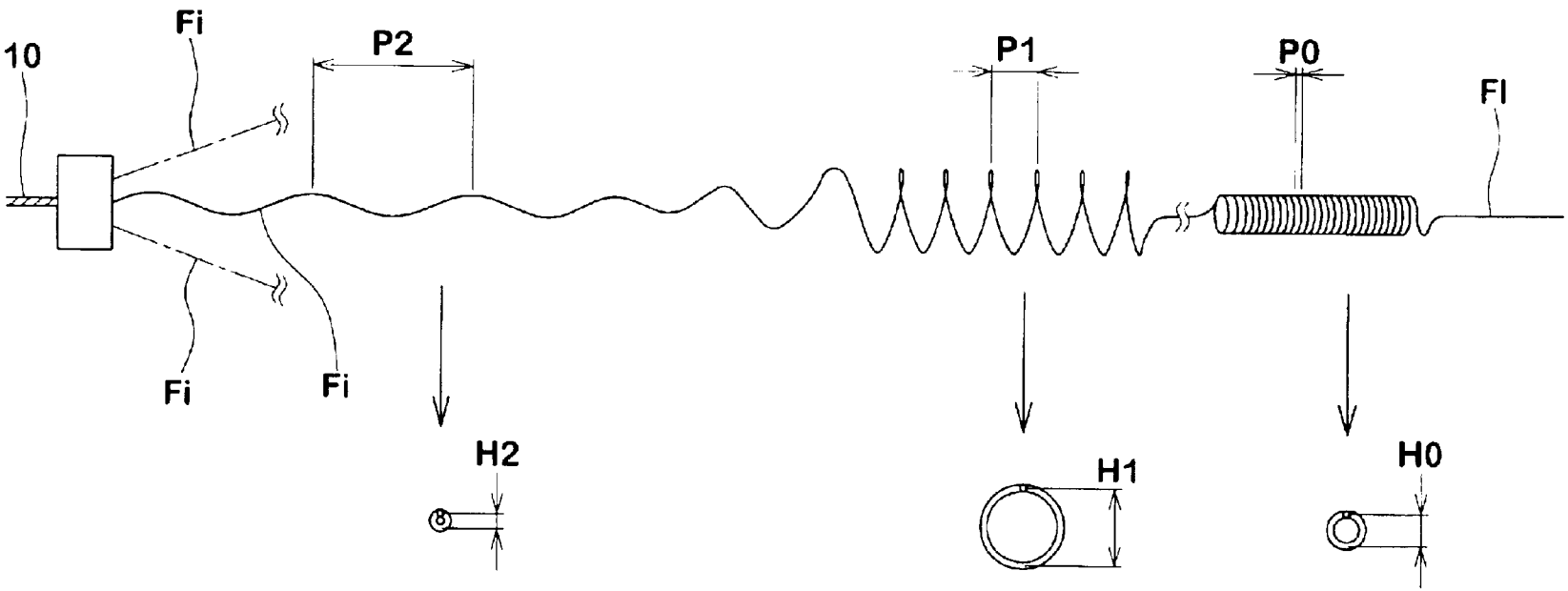
FIG. 3 is a diagram for explaining a method of making the steel cord according to the present invention.

The steel cord 10 is made up of three to six steel filaments F twisted together. Each of the three to six steel filaments F has a diameter D of from 0.25 to 0.45 mm. And the three to six filaments F include at least two shaped filaments Fi. Each of the shaped filaments Fi is such that, before twisted into a cord 10, the filament Fi (originally linear) is coiled to have permanent set. Namely, as shown in FIG. 3, a linear steel filament Fl is once coiled at small pitches P0 and a small diameter H0 so that the filament Fi is permanent set into a form of coil having increased pitches P1 and an increased diameter H1. Then, the coiled filaments Fi are twisted together while the coil diameter is decreased from H1 to H2, more specifically, the coiled filaments Fi are uncoiled or stretched (pitch increases) by giving a tension.

The coiled filaments Fi include at least two kinds of coiled filaments which are different from each other with respect to at least one of coil parameters, namely, coil pitch P1 and coil diameter H1.

Here, the coil diameter Hi is set in a range of not more than 5.0 mm preferably not more than 4.0 mm but not less than 0.5 mm preferably not less than 2.0 mm. The coil pitch P1 is set in a range of not less than 5.0 mm preferably not less than 10.0 mm but not more than 30.0 mm preferably not more than 25.0 mm The three to six steel filaments F can include a non-shaped filament, namely, a filament being linear before twisted, but it is preferable that all the filaments F are the above-mentioned shaped filaments Fi.

As to the shaped filaments Fi in a cord 10, it is preferable that all are of different coil parameters (P, H).

Further, as to the shaped filaments Fi having different coil parameters, it is preferable that they are different from each other with respect to both of the coil pitch P1 and coil diameter H1.

For example, the shaped filaments Fi can be two filaments Fi1 whose coil pitches are P11 and coil diameter is H11 and two filaments Fi2 whose coil pitches are P12(>P11) and coil diameter is H12 (>H11) as shown in FIG. 2.

As to the material for the filaments F, high-carbon steel whose carbon content is in a range of from 0.78 to 0.92 wt % is preferably used in view of the cord strength.

In any case, the target is that the elongation at 50 N load of a steel cord 10 is in a range of less than 0.2%, and the cord strength is in a range of 2500 to 3500 N/sq.mm. By adopting the above-mentioned cord making method, it becomes possible to achieve the parameters within the above-mentioned ranges.

In the steel cord according to the present invention, due to the elasticity of the coiled filaments Fi in the finished cord which may cause the coil diameter increasing, gaps are easily formed between the filaments F, and the rubber penetration into the cord is improved. For instance in comparison with zigzag bending where deformation tends to become partial, the deformation into a form of coil is even along the length of the filament. Accordingly, in the state of contact or nearly contact under loaded conditions, the filaments are relatively stable from a light load to a heavy load. And it becomes possible to control the rising initial elongation percentage. As the shaped filaments include those of different coil forms, the gap formation becomes easier, while the constructional stability is maintained on the other hand, the coiling is the best way to prevent damage on the shaped filaments. Therefore, the decrease in the cord strength and durability due to such damage during shaping may be effectively prevented.

If the coil diameter H1 is more than 5.0 mm and/or the coil pitch P1 is more than 30.0 mm, it is difficult to improve the rubber penetration. If the coil pitch P1 is less than 5.0 mm and/or the coil diameter H1 is less than 0.5 mm, the filament is subjected to a large twist stress to decrease the strength.

If the filament diameter D is less than 0.25 mm, the strength and bending rigidity become insufficient. If the filament diameter D is more than 0.45 mm, the fatigue resistance decreases.

If the total number of the filaments F in a cord is less than three, it becomes difficult to provide the necessary strength. If the total number is more than six, in order to limit the cord strength to the above-mentioned desirable range, it becomes necessary to use very fine filaments and as a result, the bending rigidity becomes insufficient.

If the elongation is not less than 0.2%, the dimensional stability of the pneumatic tire becomes worse and the workability in making rubberized cord ply becomes worse. If the cord strength is less than 2500 N/sq.mm, it is difficult to improve the tire durability. If the cord strength is more than 3500 N/sq.mm, there is a tendency for the cord to decrease the buckling strength.

Comparison Tests

Steel cords having the specifications shown in Table 1 were made and tested for the rubber penetration, constructional stability and workability.

Figure 1:
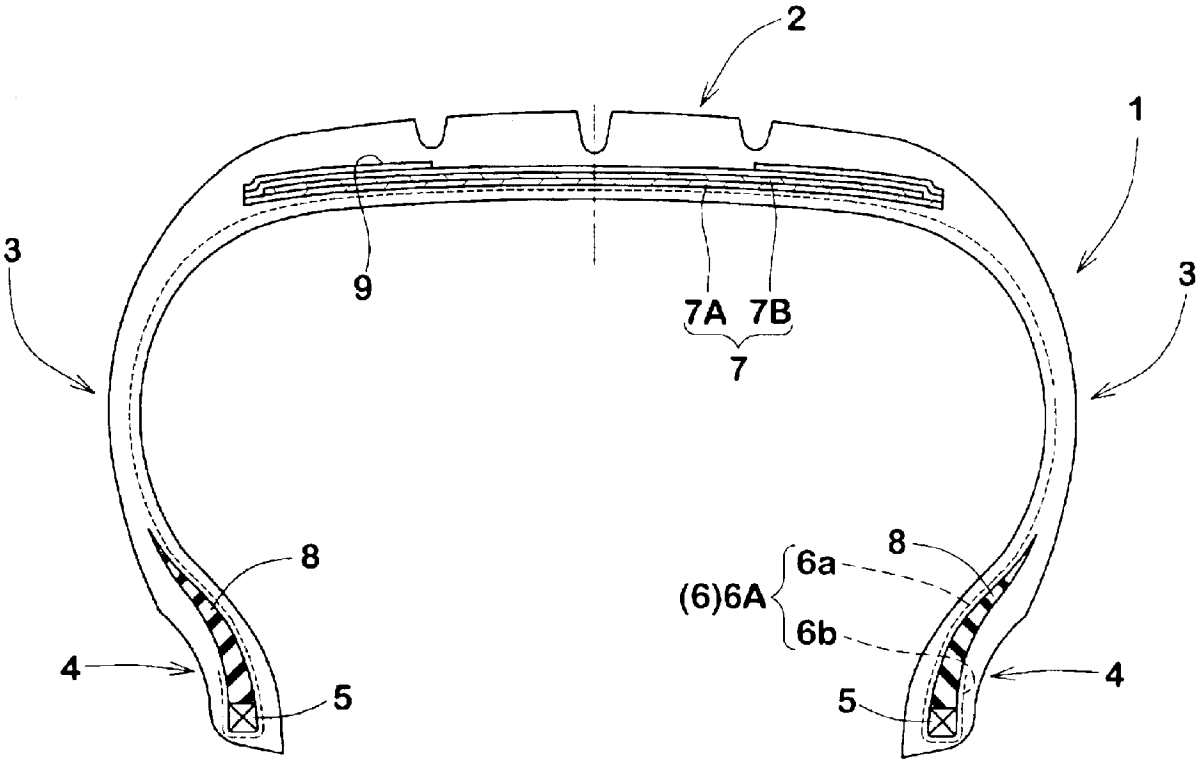
FIG. 1 is a cross sectional view of a pneumatic tire according to the present invention.

Using those test cords as breaker cords, test tires of size 195/65R15 for passenger cars having the structure shown in FIG. 1 were made and tested for the tire durability.

In the test tires, the breaker was composed of two cross plies of the steel cords shown in Table 1 laid at 22 degrees with respect to the tire equator with a cord count of 40/5 cm. The carcass was composed of a single ply of 1670 dtex/2 polyester fiber cords arranged at 90 degrees with respect to the tire equator with a cord count of 50/5 cm. The tire specifications other than shown in Table 1 were the same through all the tires.

(1) Constructional Stability Test

The cord was cut and observed whether or not loose or untwisting of the filaments was occurred at the cut end.

(2) Rubber Penetration Test

The test cords were embedded in between two topping rubber sheets, and such composite material was vulcanized for 30 minutes at a temperature of 150 degrees C., while applying a pressure of 25 kg/sq.cm to the rubber sheets. Then, the cord length of part completely penetrated by topping rubber per 10 cm cord length was observed under a microscope and the length is indicated in Table 1 in percentage.

(3) Workability in Rubber Topping

In order to make a rubberized cord ply, topping rubber was applied to parallel arranged test cords, using calender rolls, by a skilled worker who evaluated the workability into five ranks by the feelings. The higher the rank number, the better the workability.

(4) Tire Durability Test

Using a tire test drum, runable distance to breakage of the test tire was measured under the following accelerated condition: 150% of the maximum tire load specified in the Japanese Industrial Standard (JIS); 80% of the tire pressure specified in the JIS for the maximum load; and a running speed of 80 km/h. The measured distance is indicated in Table 1 by an index based on Ref.2 being 100. The larger the index number, the better the durability.

TABLE 1

| | Ref. 1 | Ref. 2 | Ex. 1 | Ref. 3 | Ex. 2 |
|---|---|---|---|---|---|
| Steel cord | | | | | |
| Structure | 1 × 4 × 0.27 | 1 × 4 × 0.27 | 1 × 4 × 0.27 | 1 × 5 × 0.38 | 1 × 5 × 0.38 |
| Carbon content (%) | 0.82 | 0.82 | 0.82 | 0.82 | 0.82 |
| Shaped filament | | | | | |
| Coiled filament | | | | | |
| Number | 0 | 4 | 4 | 5 | 5 |
| Pitch P1 (mm) | — | 12 | 12;18 | 16 | 16;20 |
| Diameter H1 (mm) | — | 3 | 2.5;3.0 | 2.5 | 2.0;2.5 |

TABLE 1-continued

| | Ref. 1 | Ref. 2 | Ex. 1 | Ref. 3 | Ex. 2 |
|---|---|---|---|---|---|
| 2D-waved filament | | | | | |
| Number | 1 | 0 | 0 | 0 | 0 |
| Wave pitch (mm) | 7.5 | | | | |
| Wave height (mm) | 0.27 | | | | |
| Non-shaped filament | | | | | |
| Number | 3 | 0 | 0 | 0 | 0 |
| Elongation @ 50 N (%) | 0.17 | 0.3 | 0.18 | 0.45 | 0.1 |
| Cord strength (N/sq.mm) | 2722 | 3056 | 3056 | 3056 | 3056 |
| Untwist | none | untwisted | none | untwisted | none |
| Rubber penetration (%) | 90 | 95 | 90 | 98 | 95 |
| Workability | 5 | 1 | 3 | 1 | 3 |
| Tire durability | 95 | 100 | 116 | — | — |

From the test results, it was confirmed that, according to the present invention, the steel cord is improved in the cord strength, rubber penetration and workability, and the initial elongation percentage of the cord is decreased. As to the tire having a breaker reinforced by the steel cords, the durability is improved.

The present invention can be applied to a cord reinforced rubber layer, e.g. carcass, band and the like aside form the breaker, in various tires, e.g. for light trucks, heavy-duty vehicle and the like aside from passenger cars, and the steel cords according to the present invention can be used to reinforce various rubber products aside from the pneumatic tires.

What is claimed is:

1. A steel cord composed of three to six steel filaments each having a filament diameter of from 0.25 to 0.45 mm, said three to six steel filaments including shaped filaments and twisted together, wherein the shaped filaments are, before twisted together, coiled to be set in a form of coil having a coil diameter of less than 5 mm and a coil pitch of more than 5 mm, the shaped filaments include at least two kinds of shaped filaments which are different in respect of the form of coil, the shaped filaments are twisted together while the coil diameter is reduced, the elongation of the cord at 50 N load is less than 0.2%, and the cord strength is in a range of from 2500 to 3500 N/sq.mm.

2. A steel cord according to claim 1, wherein all of said three to six steel filaments are the shaped filaments.

3. A steel cord according to claim 1, wherein all of the shaped filaments are different from each other in respect of the form of coil.

4. A steel cord according to claim 1, wherein all of the shaped filaments are made of steel whose carbon content is in a range of from 0.78 to 0.92 wt %.

5. A pneumatic tire comprises a tread portion and a breaker disposed in the tread portion, wherein said breaker is made of the steel cords according to claim 1, 2, 3, or 4.

6. A method of making a steel cord composed of three to six steel filaments twisted together, comprising twisting three to six steel filaments together, wherein each of the three to six steel filaments has a diameter of from 0.25 to 0.45 mm, and the three to six steel filaments include shaped filaments, making the shaped filament by coiling a steel filament to be set in the form of a coil having a coil diameter of less than 5 mm and a coil pitch of more than 5 mm, and said twisting of the three to six steel filaments which is carried out while the shaped filament is reduced in the coil diameter within the elastic deformation range thereof the shaped filaments including at least two kinds of shaped filaments which are different in respect of the form of coil, the elongation of the cord at 50 N load is less than 0.2%, and the cord strength is in a range of from 2500 to 3500 N/sg.mm.

* * * * *